United States Patent [19]

Darner

[11] Patent Number: 4,936,369

[45] Date of Patent: Jun. 26, 1990

[54] VERTICAL BLIND WITH LOUVER ROTATION CONTROL

[75] Inventor: Ronald G. Darner, Fort Atkinson, Wis.

[73] Assignee: Graber Industries, Inc., Middleton, Wis.

[21] Appl. No.: 359,521

[22] Filed: Jun. 1, 1989

[51] Int. Cl.[5] ..... E06B 9/30

[52] U.S. Cl. ..... 160/168.1; 160/176.1; 160/900

[58] Field of Search ..... 160/176.1, 177, 168.1, 160/173, 166.1, 172, 900, 178.1

[56] References Cited

U.S. PATENT DOCUMENTS

| | | | |
|---|---|---|---|
| 1,855,346 | 4/1932 | Forse . | |
| 2,116,357 | 5/1938 | Laborda et al. . | |
| 2,848,045 | 8/1958 | Bennett . | |
| 2,993,535 | 7/1961 | Taylor . | |
| 3,134,428 | 5/1964 | Kehrer et al. . | |
| 3,280,891 | 10/1966 | Eldredge, Jr. et al. . | |
| 3,463,219 | 8/1969 | Osterholz | 160/172 |
| 3,996,938 | 12/1976 | de Wit | 160/168.1 |
| 4,122,884 | 10/1978 | Salzmann . | |
| 4,214,622 | 7/1980 | Debs . | |
| 4,261,408 | 4/1981 | Debs | 160/176.1 |
| 4,262,728 | 4/1981 | Debs | 160/176.1 X |
| 4,386,644 | 6/1983 | Debs . | |
| 4,657,060 | 4/1987 | Kaucic . | |

*Primary Examiner*—David M. Purol

*Attorney, Agent, or Firm*—Vernon J. Pillote

[57] ABSTRACT

A vertical blind of the type having a plurality of louver carriages mounted for movement along a guide channel, with a louver carrier mounted on each carriage for rotation about an upright axis and carriage gear mechanism for rotating the louvers in response to turning of an operating shaft that extends lengthwise of the channel. A wand is attached to a drive lever at one end of the channel and the wand is arranged to angularly oscillate the drive lever in response to raising and lowering of the wand and to rotate the operating shaft through an angular motion amplifying mechanism, to rotate the louvers through 180° in response to raising and lowering of the wand. The wand is preferably tubular and one of the cords in the operating loop is arranged to extend through the tubular wand to separate the cords.

18 Claims, 2 Drawing Sheets

VERTICAL BLIND WITH LOUVER ROTATION CONTROL

BACKGROUND OF THE INVENTION

Vertical blinds generally include a horizontal carriage guide channel, an operating shaft extending lengthwise of the channel, a plurality of louver carriages mounted on the channel for movement therealong, each having a louver carrier mounted for rotation about an upright axis and carriage gear means engageable with the shaft and with the associated louver carrier for rotating the louver carrier in response to rotation of the shaft, drive housing at one end of the guide channel, a shaft turning mechanism mounted on the drive housing for turning the shaft, and carriage traverse means for moving at least a lead one of the carriages along the channel. Some prior vertical blinds for example as disclosed in U.S. Pat. Nos. 2,848,045; 2,993,535; 3,134,428; 3,280,891 and 4,657,060, used a cord or bead chain connected either directly or through gearing to a drive pulley at one end of the operating shaft to rotate the shaft in response to a downward pull on one or the other of the sides of the cord loop. However, the operating portions of the traverse cords for moving the louver carriages along the channel are commonly located at the same end of the channel as the louver rotating mechanism and this not only tended to cause tangling of the several operating cords and chains but also induced operator confusion as to which cord or chain should be manipulated to effect louver traversing and which should be manipulated to effect louver rotation. Some other vertical blinds for example as disclosed in U.S. Pat. Nos. 4,122,884; 4,214,622 and 4,386,644, used a wand that was connected through a gear mechanism to the operating shaft to rotate the operating shaft in response to turning of the wand about its lengthwise axis. The wands were usually connected through the operating shaft through a speed reducing gear drive, to minimize the torque required to rotate the operating shaft. However, this usually required rotation of the wand through a number of turns in order to rotate the louvers through 180°.

It has also been proposed as shown in U.S. Pat. Nos. 1,855,346 and 2,116,357 to tilt the head rail of a horizontal venetian blind using a wand connected to a lever attached to the head rail. However, such arrangements are only adapted for tilting the head rail through an angle of somewhat less than 180°, since the turning moment exerted by the vertically movable wand on the lever rapidly approaches zero as the lever is moved to either the top dead center or the bottom dead center position with respect to the head rail tilt axis.

In a vertical blind, the louvers must be rotated through substantially 180° in order to move the louvers from a closed position in one direction to a closed position in the opposite direction. The operating shaft must transmit sufficient torque along its length to rotate all of the louvers through the associated carriage gears and there is a tendency for the operating shaft to twist under the torsional load on a long blind. The problem of twisting of the operating shaft is markedly aggravated when the gear ratio of the carriage gear mechanism is increased to rotate the louvers through a greater angle than the angle of rotation of the operating shaft and can cause incomplete closing of the louvers at the end of the blind remote from the drive end of the operating shaft. On the other hand, there is usually substantial backlash in the carriage gears so that the operating shaft must be rotated through a somewhat greater angle than the nominal gear ratio of the carriage gear mechanism would indicate. It has accordingly been common practice to provide a carriage gear mechanism in which the gear ratio between the shaft and louver carrier was 1:1 or less, and to provide either a bead chain or rotary wand type drive for rotating the operating shaft through an angle substantially greater than 180°.

SUMMARY OF THE INVENTION

It is an object to overcome the disadvantage of the prior art by providing a vertical blind having an improved louver rotation control which is easy to operate; enables rapid angular positioning of the louvers, and which avoids operator confusion with the operating cords for traversing the louver carriages.

Accordingly, the present invention provides a vertical blind having an improved mechanism for rotating the operating shaft and which mechanism includes a drive lever mounted on a housing at one end of the guide channel for angular oscillation at a horizontal axis paralleling the operating shaft, the drive lever having one end adjacent one side of the channel and a wand attached to said one end and extending downwardly therefrom for oscillating the drive lever through a first angle substantially less than 180° in response to upward and downward movement of the wand, and angular motion transmitting means interconnecting the drive lever and the shaft and operative in response to angular oscillation of the drive levers through the first angle to oscillate the shaft through a second angle substantially greater than the first angle. The carriage gear means on the louver carriages are constructed and arranged to rotate the louver carrier through an angle of substantially 180° in response to rotation of the shaft through said second angle.

The wand is advantageously tubular and one of the operating cords for traversing the carriages along the channel is extended through the tubular wand to separate the traverse cords and facilitate traversing the carriages along the channel while adjusting the angular position of the louvers.

DETAILED DESCRIPTION

Figure 6:
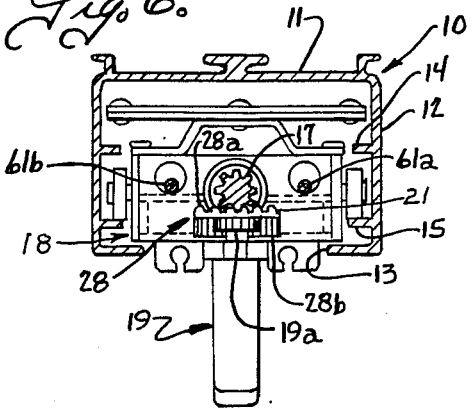
FIG. 6 is a transverse sectional view taken on the plane 6—6 of FIG. 1.

The vertical blind includes a carriage guide channel 10 having a top wall 11, depending side walls 12 and a lengthwise extending opening 13 in the bottom. As best shown in FIG. 6, upper and lower guide rails 14 and 15 are provided on the side walls 12 for guiding the louver carriages along the channel. A drive housing 16 is provided at one end of the channel and an operating rod 17 extends lengthwise of the channel and is supported at one end on the drive housing 16 and at the other end on a support member (not shown). A plurality of louver carriages 18 (FIG. 6) are mounted on the guide channel for movement therealong and each have a louver carrier 19 mounted thereon for rotation about an upright axis and carriage gear means 21 engageable with the operating shaft 17 and with the associated louver carrier for rotating the louver carrier about the upright axis in response to rotation of the operating shaft. Louvers 22 (FIG. 1) are suspended from the louver carriers and, in order to move the louvers from a closed position in one direction through a fully opened position to a closed position in the opposite direction, it is necessary to rotate the louvers through substantially 180°. The single operating shaft rotates all of the louvers through the individual carriage gear mechanisms and the operating shaft has a small cross section compared to the overall length of the vertical blind. In order to avoid objectionable angular displacement between the drive and the remote end of the operating shaft, which can cause non-uniform closing of the louvers, the carriage gear mechanism is preferably arranged to have a ratio of not substantially greater than 1:1 between the operating shaft and the louver carrier. In the embodiment shown, the carriage gear means is of the rack and pinion type disclosed in U.S. Pat. No. 4,122,884, disclosure of which is incorporated herein by reference. In general, the operating shaft 17 is longitudinally splined with a cross section similar to a pinion gear and the carriage gear mechanism includes a rack 28 mounted on each carriage for sliding movement crosswise of the operating shaft 17, and which has upwardly facing rack teeth 28*a* that mesh with the operating shaft and laterally facing rack teeth 28*b* on the side that mesh with a pinion gear 19*a* on the louver carrier 19. For reasons which will become apparent hereinafter, the carriage gear mechanism is preferably arranged so that the nominal gear ratio between the drive pinion and the louver pinion is substantially 1:1. There is some backlash between the gears of the carriage gear mechanism and, in order to rotate the louvers through 180°, a carriage gear mechanism having a nominal 1:1 gear ratio will still require the operating shaft to be rotated through somewhat greater than 180°, for example about 190° to 200°, in order to rotate the louvers through a full 180°.

An improved wand drive mechanism is provided for rotating the operating shaft 17 in response to raising and lowering of a wand 31. The wand drive mechanism includes a drive lever 33 mounted on the drive housing for pivotal movement about a horizontal lever axis A parallel to the axis B of the operating shaft 17. The lever has one end portion 33*a* disposed adjacent one side of the channel and the wand is pivotally attached by the pivot means 32 to the end 33*a* of the lever, to angularly oscillate the lever about the axis A in response to raising and lowering of the wand. The turning moment exerted by the wand on the drive lever diminishes to zero as the lever approaches either its top dead center or a bottom dead center with respect to the axis A and, in practice, the wand is only effective to oscillate the lever 33 through an angle substantially less than 180°, for example about 110° to 120°. An angular motion transmitting mechanism is provided to interconnect the drive lever 33 and the shaft 17 to rotate the shaft through a second angle substantially greater than the angular motion of the lever 33 and sufficient to rotate the slats through 180° in response to movement of the drive lever through an angle substantially less than 180°. In the preferred embodiment illustrated, the angular motion transmitting mechanism includes a crank lever 41 having an internally splined hub 42 non-rotatably connected to one end of the operating shaft 17. The drive housing 16 includes a wall portion 45 that extends across an end of the channel 10 and a sleeve portion 46 formed integrally with the wall portion 45 and which rotatably supports the hub 42 for turning with the operating shaft about the axis B of the shaft. The crank member 41 has a crank pin 41*a* radially offset from the axis B of the operating shaft and the drive lever 33 is operatively connected to the crank pin 41*a* to rotate the crank and operating shaft. The axis A of the drive lever 33 is offset from the axis of rotation B of the operating shaft 17 and crank lever 41 and the drive lever has a crank pin groove 33*b* to slidably receive the crank pin 41*a*. The slat rotating mechanism is advantageously arranged so that the drive lever is in a mid-position, in which the connection of the wand to the drive lever is generally horizontally offset from the drive lever pivot axis A at one side of the channel, when the louvers are in the fully open position, and the crank lever is movable in one direction from the mid-position to close the louvers in one direction and movable in the opposite direction from the mid-position to close the louvers in the opposite direction. In the preferred embodiment shown, the crank pin groove 33*b* extends generally radially of the lever pivot axis A and the lever pivot axis is horizontally offset from the axis B of the crank lever and operating shaft. In the mid-position of the drive lever 33 shown in FIG. 2, the crank pin 41*a* is disposed in a plane through the axes A and B and at the side of the axis B remote from the axis A. The horizontal offset or spacing between the lever pivot axis A and the axis B is preferably about equal to the throw of the crank lever. With this arrangement, the drive lever 33 will rotate the crank lever and operating shaft through an angle about two times the angular movement of the drive lever. Thus, angular movement of the drive lever through 90° will rotate the operating shaft through 180°. As previously described, there is some backlash in the carriage gear so that it is necessary to rotate the operating shaft through somewhat greater than 180°; for example through about 190° or 200° in order to rotate the louvers through a full 180°, and there is some further looseness and lost motion in the shaft operating mechanism. Accordingly, with the carriage gear mechanism having a nominal 1:1 ratio and a shaft operating mechanism having about a 2:1 ratio, it is necessary to oscillate the drive lever 33 through an angle of somewhat greater than 90°, for example of the order of 110° to 120° in order to rotate the louvers through a full 180°.

Figure 4:
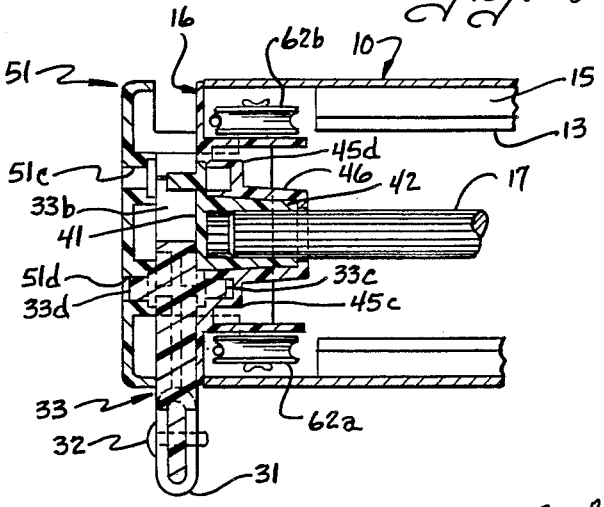
FIG. 4 is a horizontal sectional view taken on plane 4—4 of FIG. 2.

The louver rotating mechanism is advantageously arranged so that the wand can be located at either side of the operating channel for left hand or right hand operation. As best shown in FIG. 4, the drive lever 33 is formed with pintles 33*c* and 33*d* that extend from relatively opposite sides at the drive lever pivot axis A, and the housing 45 is formed with journal sockets 45*c* and 45*d* at relatively opposite sides of the axis B. The journal socket 45*c* is arranged to receive the pintle 33*c* when the drive lever is mounted to support the wand at one side of the channel and the journal socket 45*d* is arranged to receive the pintle 33*d* when the drive lever is arranged to support the wand at the other side of the channel. In order to minimize the likelihood of improper assembly, the pintles 33c and 33d are formed with relatively different cross sections and journal 45c is arranged to pivotally receive only the pintle 33c and journal 45d is arranged to pivotally receive only the pintle 33d.

A housing cover 51 is provided for covering the end of the operating mechanism and for retaining the parts in assembled relation on the housing. The housing cover overlies the drive lever 33 and has upper and lower integral hooks 51a and 51b arranged to snap over an edge of the wall portion 45 of the drive housing. As best shown in FIG. 4, the cover is formed with a journal socket 51d for receiving the pintle 33d when the drive lever is positioned as shown in the drawings, and a second journal socket 51c for receiving the pintle 33c, when the drive lever is positioned to extend from the other side of the channel.

Figure 1:
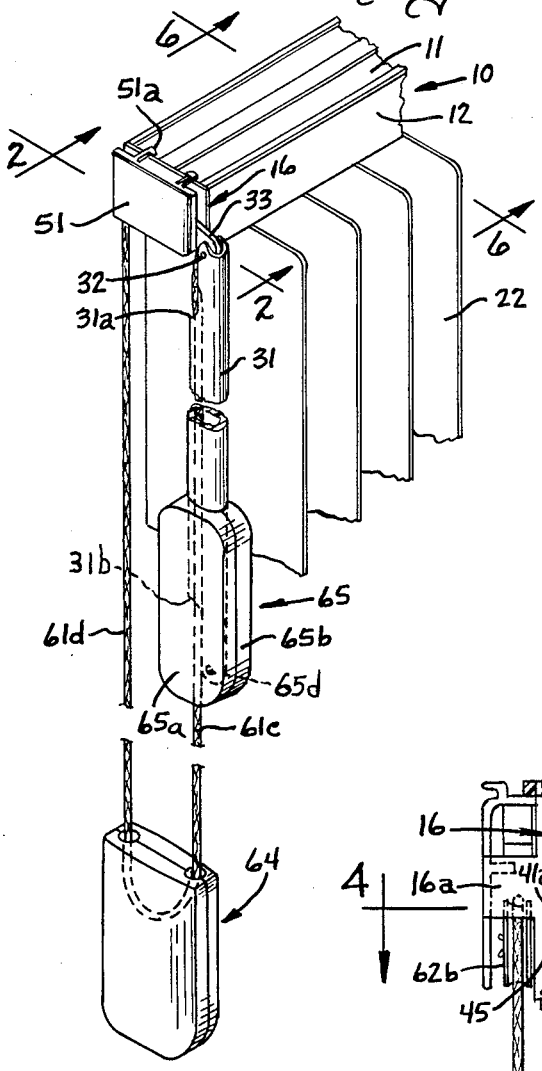
FIGURE 1 is a fragmentary perspective view of a vertical blind embodying the present invention.
Figure 2:
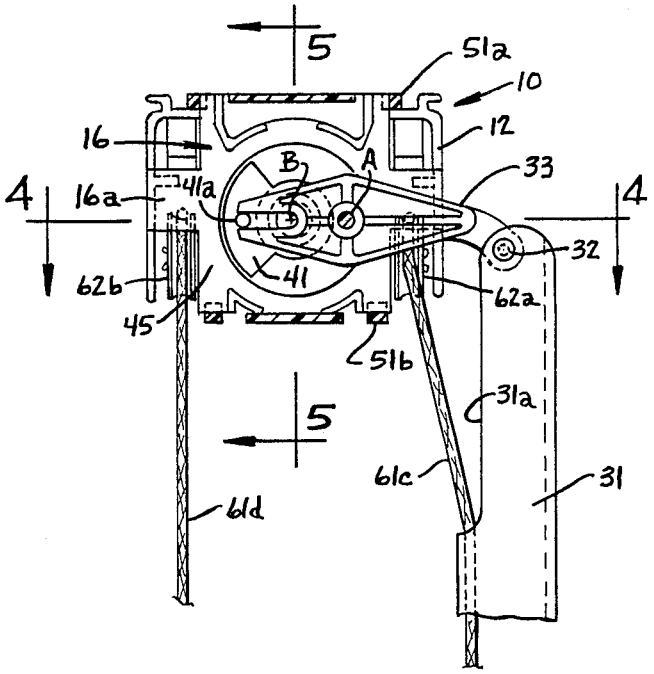
FIG. 2 is a transverse sectional view taken on the plane 2—2 of FIG. 1 and illustrating the parts on a larger scale than FIG. 1.
Figure 3:
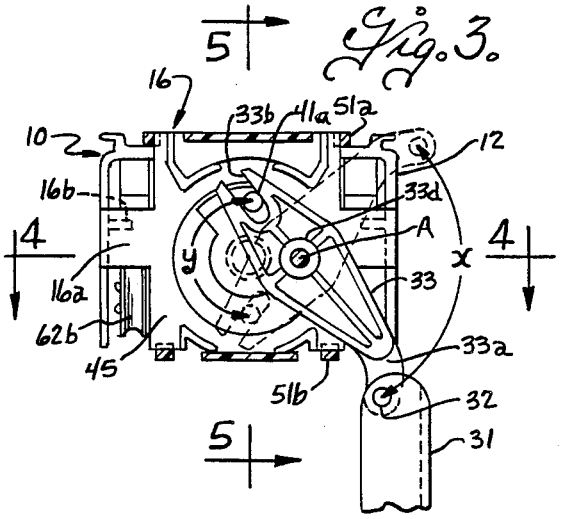
FIG. 3 is a transverse sectional view taken on the plane 2—2 of FIG. 1 and illustrating the parts in moved position.

The louver carriages are traversed along the channel by a cord type traverse mechanism. As is conventional, the cord type traverse mechanism includes a traverse cord that is entrained over cord guides such as pulleys 62a and 62b on the drive housing 16, with generally horizontal runs 61a and 61b of the traverse cord extending lengthwise of the channel and entrained over a cord guide (not shown) at the other end of the channel, with ends of the traverse cords connected to one or more lead carriages to move the same along the channel. The traverse cord also has an operating cord loop including runs 61c and 61d that extend downwardly from the cord guides 62a and 62b. As is conventional, a cord weight 64 is provided at the bottom of the operating loop to weight the loop and guide the cords between the runs 61c and 61d. The wand 31 is advantageously of tubular construction and the downwardly extending run such as 61c that is located at the same side of the channel as the wand, is extended downwardly through the wand. As best shown in FIGS. 1 and 2 one end of the wand 31 is notched at 31a along one side to facilitate guiding of the run 61c of the cord loop from the cord guide 62a into the tubular wand. In order to enable attachment of the wand to the operating lever when it is positioned at the other side of the channel, without requiring removal of the wand from the cord, the other end of the wand is also advantageously formed with a notch indicated at 31b in FIG. 1 of the same size as the notch 31a. The wand may be formed of a resilient and preferably transparent plastic and the wand is preferably shaped with an oblong cross section to avoid suggesting to the operator that the wand should be rotated or twisted. The pivot means 32 is conveniently a push-through type connector and the drive lever 33 and both ends of the wand are formed with connector receiving openings to enable attaching either end of the wand to the drive lever.

An operating handle 65 is advantageously mounted on the lower end of the wand. The handle may be formed of two half-sections 65a and 65b adapted to be snap-fitted together at opposite sides of the wand adjacent its lower end, and the half-sections are formed with internal pins 65d adapted to extend into the connector receiving openings in the lower end of the wand to connect the wand to the handle for movement therewith. One of the operating runs such as 61c of the traverse cord extends downwardly through the wand and handle and out through an opening in the bottom of the handle. In order to convert the control from left operation as shown to right operation, the half-sections of the handle can be removed from the lower end of the wand and the upper end wand detached from the drive lever. The wand can then be slid along the cord without removing the wand from the cord and, after reversing the drive lever so that the end portion 33a extends from the other side of the rod, one end of the wand can be reconnected to the drive lever and the handle 65 re-attached to the other end of the wand.

Figure 5:
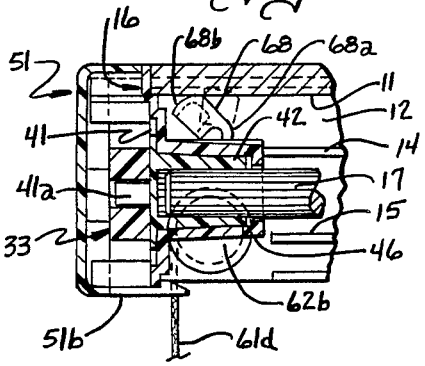
FIG. 5 is a vertical sectional view taken on the plane 5—5 of FIG. 2.

The drive housing 16 may be mounted on the channel 10 in any suitable manner. In the embodiment illustrated the drive housing is formed with side portions 16a having recesses or grooves 16b for receiving the upper rails 14 adjacent one end of the channel. As best shown in FIG. 5, a one-way pawl 68 is connected through an integral flexible portion 68a with each of the side portions 16a of the drive housing, and the pawls have a cam face 68b arranged to engage the top wall of the channel. The pawls are adapted to be deflected laterally at an acute angle when the drive housing is pressed into the end of the channel, and cam face 68b is arranged to engage the top wall of the housing and inhibit withdrawal of the housing from the channel.

From the foregoing it is believed that the construction and operation of the vertical blind will be readily understood. The drive lever and crank member can be arranged so that the wand is supported at either side of the channel and the wand is operative, when raised and lowered, to move the drive lever through an angle X that is somewhat greater than 90° and less than 180°. Rotation of the drive lever is transmitted through the crank member to the operating shaft such that the crank member is rotated through an angle substantially greater than the angular movement of the drive lever. The carriage gear mechanism is preferably of a type having about a 1:1 gear ratio and the shaft operating mechanism is preferably arranged to have about a 2:1 ratio so as to rotate the shaft through an angle of somewhat greater than 180° in response to angular movement of the operating arm of only slightly greater than 90°. One run of the operating cord for traversing the louvers is preferably arranged to extend downwardly through the tubular wand to aid in separating the cords and facilitate operation.

The embodiments of the invention in which an exclusive property or privilege is claimed are defined as follows:

1. In a vertical blind of the type including a horizontal carriage guide channel having laterally spaced sides and an opening along a bottom side thereof, a horizontal shaft having a longitudinal axis extending lengthwise of the guide channel, a plurality of louver carriages mounted on the guide channel for movement therealong and each having a louver carrier mounted thereon for rotation about an upright axis and carriage gear means engageable with the shaft and with the associated louver carrier for rotating the louver carrier about said upright axis in response to rotation of the shaft, a drive housing at one end of the guide channel, a shaft turning mechanism mounted on the housing for turning the shaft, and carriage traverse means for moving at least a lead one of the carriages along the channel, the improvement comprising, said shaft turning mechanism including a drive lever mounted on the housing for angular oscillation about a horizontal lever axis paralleling the shaft, the drive lever having one end adjacent one side of the channel and a wand attached to said one end of said drive lever and extending downwardly therefrom for oscillating said drive lever through a first angle of substantially less than 180° in response to upward and downward movement of the wand, and angular motion transmitting mechanism interconnecting said drive lever and said shaft and operative in response to angular oscillation of said drive lever through said first angle to oscillate the shaft through a second angle substantially greater than said first angle, said gear means on the louver carriages being constructed and arranged to rotate the louver carriers through an angle of substantially 180° in response to rotation of said shaft through said second angle. rotation of said shaft through said second angle.

2. A vertical blind according to claim 1 wherein said first angle is not greater than about 105°.

3. A vertical blind according to claim 1 wherein said second angle is about two times said first angle.

4. In a vertical blind according to claim 1 wherein the angular motion of the drive lever required to produce 180° rotation of the louver carrier is not greater than about 105°.

5. A vertical blind according to claim 1 wherein the angular motion transmitting mechanism is constructed and arranged to produce at least 180° angular movement of the shaft in response to no more than 105° angular movement of the drive lever.

6. A vertical blind according to claim 1 wherein said angular motion transmitting mechanism includes a crank lever non-rotatably connected to the shaft and mounted on the housing for angular oscillation about the axis of the shaft, and means operatively connecting said drive lever to said crank lever.

7. A vertical blind according to claim 1 wherein the angular motion transmitting mechanism includes a crank lever non-rotatably connected to the shaft and mounted on the housing for angular oscillation about the axis of the shaft, said crank lever having crank pin means spaced from the shaft axis, the lever axis of the drive lever being offset from said shaft and said drive lever having a follower groove arranged to receive said crank pin means.

8. A vertical blind according to claim 1 wherein said carriage traverse means includes traverse cord means having first and second operating portions extending downwardly from said housing, said wand being tubular and one of said operating portions extending through said wand, and the other of said operating portions being spaced from said wand.

9. A vertical blind according to claim 1 wherein said wand is tubular, said carriage traverse means includes traverse cord means having a cord loop extending downwardly from the housing, the cord loop having one portion extending downwardly through the tubular wand and operative when pulled downwardly to move the carriages in one direction along the channel, and the cord loop having a second portion outside the wand and operative when pulled downwardly to move the carriages in a direction opposite said one direction.

10. A vertical blind of the type including a horizontal carriage guide channel having laterally spaced sides and an opening along a bottom side thereof, a horizontal shaft extending lengthwise of the guide channel, a plurality of louver carriages mounted on the guide channel for movement therealong and each having a louver carrier mounted thereon for rotation about an upright axis and gear means engageable with the shaft and with the associated louver carrier for rotating the louver carrier about said upright axis in response to rotation of the shaft, a housing at one nd of the guide channel, a shaft turning mechanism mounted on the housing for turning the shaft about a first axis, and carriage traverse means for moving at least a lead one of the carriages along the channel, the improvement comprising, said shaft turning mechanism including a crank lever non-rotatably connected to the shaft and mounted on the housing for angular oscillation about the first axis, the crank lever having crank pin means and a preselected crank throw, a drive lever mounted on the housing for angular oscillation about a horizontal second axis parallel to and spaced from the first axis, a wand attached to one end of said drive lever and extending downwardly therefrom for oscillating said drive lever through a first angle of substantially less than 180° in response to upward and downward movement of the wand, the drive lever having a crank pin groove extending generally radially of the second axis and slidably receiving the crank pin means and operative in response to angular oscillation of said drive lever through said first angle to oscillate the shaft through a second angle substantially greater than said first angle, said gear means on the louver carriers being constructed and arranged to rotate the louver carrier through an angle of substantially 180° in response to turning the shaft through said second angle.

11. A vertical blind according to claim 10 wherein said drive lever has first and second pintles extending from opposite sides thereof at said second axis, said housing having first and second journals spaced the same distance from relatively opposite sides of the first axis, the first journal being adapted to receive the first pintle when the drive lever is positioned with said one end thereof adjacent one side of the channel and the second journal being adapted to receive said second pintle when the drive lever is positioned with said one end thereof adjacent the other side of the channel.

12. A vertical blind according to claim 11 wherein said first and second pintles have relatively different cross-sections, said first journal being dimensioned to rotatably receive said first pintle and said second journal being dimensioned to receive said second pintle.

13. A vertical blind according to claim 12 including an end cap adapted for assembly on the housing and overlie the drive lever, the end cap having a first socket adapted to rotatably receive the second pintle when first pintle on the drive lever is in said first journal and a second socket adapted to rotatably receive the first pintle when the second pintle on the drive lever is in said second journal.

14. A vertical blind according to claim 10 wherein the second axis is spaced from the first axis a distance about equal to the crank throw.

15. A vertical blind according to claim 10 wherein the drive lever is arranged to move the crank lever angularly in relatively opposite directions from a mid-position in which the crank pin means is disposed in a plane through the first and second axes and at the side of the first axis remote from the second axis.

16. A vertical blind according to claim 10 wherein the drive lever is arranged to move the crank lever angularly in relatively opposite directions from a mid-position in which the crank pin means is disposed in a plane through the first and second axes and at the side of the first axis remote from the second axis, said second axis being spaced from the first axis a distance about equal to the crank throw.

17. A vertical blind according to claim 10 wherein said carriage traverse means includes traverse cord means having first and second operating portions extending downwardly from said housing, said wand being tubular and one of said operating portions extending through said wand, and the other of said operating portions being disposed outside sand wand.

18. A vertical blind according to claim 10 wherein said wand is tubular, said carriage traverse means includes traverse cord means having a cord loop extending downwardly from the housing, the cord loop having one portion extending downwardly through the tubular wand and operative when pulled downwardly to move the carriages in one direction along the channel, and the cord loop having a second portion outside the wand and operative when pulled downwardly to move the carriages in a direction opposite said one direction.

* * * * *

UNITED STATES PATENT AND TRADEMARK OFFICE

CERTIFICATE OF CORRECTION

PATENT NO. : 4,936,369

DATED : June 26, 1990

INVENTOR(S) : Ronald G. Darner

It is certified that error appears in the above-identified patent and that said Letters Patent is hereby corrected as shown below:

Column 7, line 66, "nd" should be -- end --.

Signed and Sealed this

Fourteenth Day of May, 1991

*Attest:*

HARRY F. MANBECK, JR.

*Attesting Officer*

*Commissioner of Patents and Trademarks*